United States Patent [19]

Altnau

[11] 4,250,724

[45] Feb. 17, 1981

[54] SUSPENSION SYSTEM FOR TUB ASSEMBLY IN CLOTHES WASHING MACHINE

[75] Inventor: Ronald L. Altnau, Ripon, Wis.

[73] Assignee: Raytheon Company, Lexington, Mass.

[21] Appl. No.: 2,450

[22] Filed: Jan. 10, 1979

[51] Int. Cl.[2] ..... D06F 37/24

[52] U.S. Cl. ..... 68/23.2; 68/23.3; 74/573 R; 210/363; 248/559; 248/582; 248/583

[58] Field of Search ..... 68/23.2, 23.3; 233/1 C, 233/23 A; 210/363, 364; 74/573 R; 248/559, 582, 583

[56] References Cited

U.S. PATENT DOCUMENTS

| | | | |
|---|---|---|---|
| 2,366,236 | 1/1945 | Clark | 68/23.2 X |
| 2,405,404 | 8/1946 | Clark | 210/363 X |
| 2,474,370 | 6/1949 | Russell | 74/573 R X |
| 2,836,993 | 6/1958 | Johnson et al. | 68/23.3 X |
| 3,021,997 | 2/1962 | Czech | 68/23.3 X |
| 3,277,742 | 10/1966 | Jacobsen | 210/364 X |
| 3,285,419 | 11/1966 | Smith | 68/23.3 X |
| 3,493,118 | 2/1970 | Brucken | 210/364 |
| 3,535,897 | 10/1970 | Douglas | 68/23.3 |
| 3,598,460 | 8/1971 | Herrin | 68/23.3 X |
| 3,922,891 | 12/1975 | Sundstrom, Jr. | 68/23.3 |
| 3,922,892 | 12/1975 | Bochan | 210/364 X |

*Primary Examiner*—Philip R. Coe

*Attorney, Agent, or Firm*—Steven R. Gustafson; Robert W. Hoke, II

[57] ABSTRACT

A suspension system for a washing machine including a tub assembly having an outer stationary tub and an inner clothes receiving tub mounted for rotation on a central shaft extending downwardly through the lower wall of the stationary tub, comprises a first support cup defined in the base of the washing machine, support legs spaced about the periphery of and attached at first ends to the outer tub and at opposite ends to a second support cup shaped complementarily to the first cup. In a preferred embodiment, the shape of the support cups is a truncated hemisphere. The second support cup is received in the first cup to support the tub assembly on the base. A plurality of spring members are provided about the periphery of the outer tub, extending between the last mentioned tub and base to aid in stabilizing the tub assembly. A transmission, drive pulley and a brake assembly also mounted on the central rotatable shaft, serve as a drive mechanism for the washing machine, the pulley being coupled by a drive belt to a drive motor mounted on the base of the machine. A balance ring member of a predetermined weight is coupled to the central shaft for rotation therewith and is located as near as is practical to the true center of mass of the inner rotatable tub and washing machine drive mechanism, for stabilizing the rotating tub during high speed spinning, even when a clothes load in the tub is out of balance.

11 Claims, 5 Drawing Figures

SUSPENSION SYSTEM FOR TUB ASSEMBLY IN CLOTHES WASHING MACHINE

BACKGROUND OF THE INVENTION

This invention relates generally to a suspension system for a clothes washer appliance and more particularly to a suspension system for the vertically mounted tub assembly employed therein including a spin or wash tub into which clothes to be washed are placed.

Different types of suspension systems for supporting the wash tub assembly in a clothes washing machine are shown in the prior art. Many such systems provide stabilization of the spin tub of the tub assembly, especially during a spin cycle when the clothes load therein is out of balance, to minimize the transfer of vibration from the rotatably mounted spin tub to the washing machine housing and base.

Several such systems employ a downwardly facing convex support member upon which an outer stationary tub in which the rotatable spin tub is received, is mounted. The support member is received in a complementarily shaped support surface, thereby providing a seat for the first mentioned member. Examples of such systems are illustrated in U.S. Pat. Nos. 2,836,993; 3,021,997; 3,493,118; 3,922,891; and 3,922,892.

Other washer tub suspension systems employed in the prior art include inverted, interfacing convex members for supporting the vertically mounted rotatable spin tub. Examples of such systems are shown in U.S. Pat. Nos. 3,277,742; 3,285,419; 3,535,897; and 3,598,460.

While the above described suspension systems reduce to some extent the transfer of vibration from the spin tub to the washing machine housing and base, the systems provide damping of vibrations only for relatively small out-of-balance loads.

Other remedies for diminishing the vibrations produced in a spinning wash tub by an out-of-balance load have been devised. One such remedy includes the provision of a weighted ring, commonly referred to as a "balance ring", placed along or near the upper rim of the washer spin tub. The theory is based on the principle of a spinning toy top; i.e., that the weighted ring placed at or very near the head of the top tends to produce a balanced spinning thereof. While such rings do aid in stabilizing out-of-balance spinning wash tubs, they alone do not satisfactorily solve the out-of-balance problem.

SUMMARY OF THE INVENTION

Accordingly, it is a primary object of the present invention to provide a new and improved suspension system for counteracting and stabilizing an out-of-balance condition in the spin tub of a clothes washing machine, thereby minimizing vibrations caused by such condition in the washing machine housing and the base thereof.

It is a further object of the present invention to provide a suspension system of the above described type which is relatively simple in design, yet most effective to achieve the desired results discussed.

Briefly, a preferred embodiment of the clothes washing machine suspension system according to the invention includes a base having a truncated, hemispherical cup formed therein. A complementarily shaped support cup is secured by rigid mounting legs to an outer stationary tub of the washing macine. The support cup is seated in the base cup and is pivotal with respect thereto. In one embodiment, a perforated felt pad is provided at the interface of the cups. Lubricant is spread over the pad and is retained in the perforations, thereby maintaining the cup interface properly lubricated over a relatively long period of time. Alternatively, an intermediate cup shaped member of plastic or the like material having low friction qualities, can be positioned between the base and support cups.

Coiled retaining springs joining the bottom of the outer tub and base are spaced peripherally thereabout. An inner rotatable spin tub is located within the outer tub and is mounted on a central shaft which extends downwardly through the outer tub in the direction of the support cup. A pulley is mounted on the lower end of the shaft, above the mated cups. A suitable motor mounted on the base adjacent the support shaft is joined to the pulley by a drive belt. A transmission is also provided on the shaft above the pulley. The transmission functions to transfer rotation of the shaft in one direction only to an agitator for washing articles of clothing placed in the tub and to rotate the entire inner tub at relatively high speed in the opposite direction during the spin cycle. The pulley assembly, a brake assembly and transmission comprise a drive mechanism for the washing machine.

A balance ring forming a part of the suspension system according to the invention, is mounted on the transmission housing for rotation therewith, directly beneath the bottom wall of the outer tub. This location is as near to the true center of mass of the spinning tub and rotating drive mechanism as is practical. The balance ring is preferably of a molded plastic construction, forming a hollow cavity which is filled with concrete or the like material to provide the proper weight thereto. The location of the balance ring is of special importance. Placement of the ring as described insures that the rotating spin tub remains in balance even under increased out-of-balance weight distribution of the clothes being spun therein.

The mating hemispherical cup support and balance ring combination comprising the suspension system according to the invention, provides increased stability to the washer tub, especially during the spin cycle, thus minimizing vibration of the washing machine housing and base.

DETAILED DESCRIPTION OF THE DRAWINGS

Figure 1:
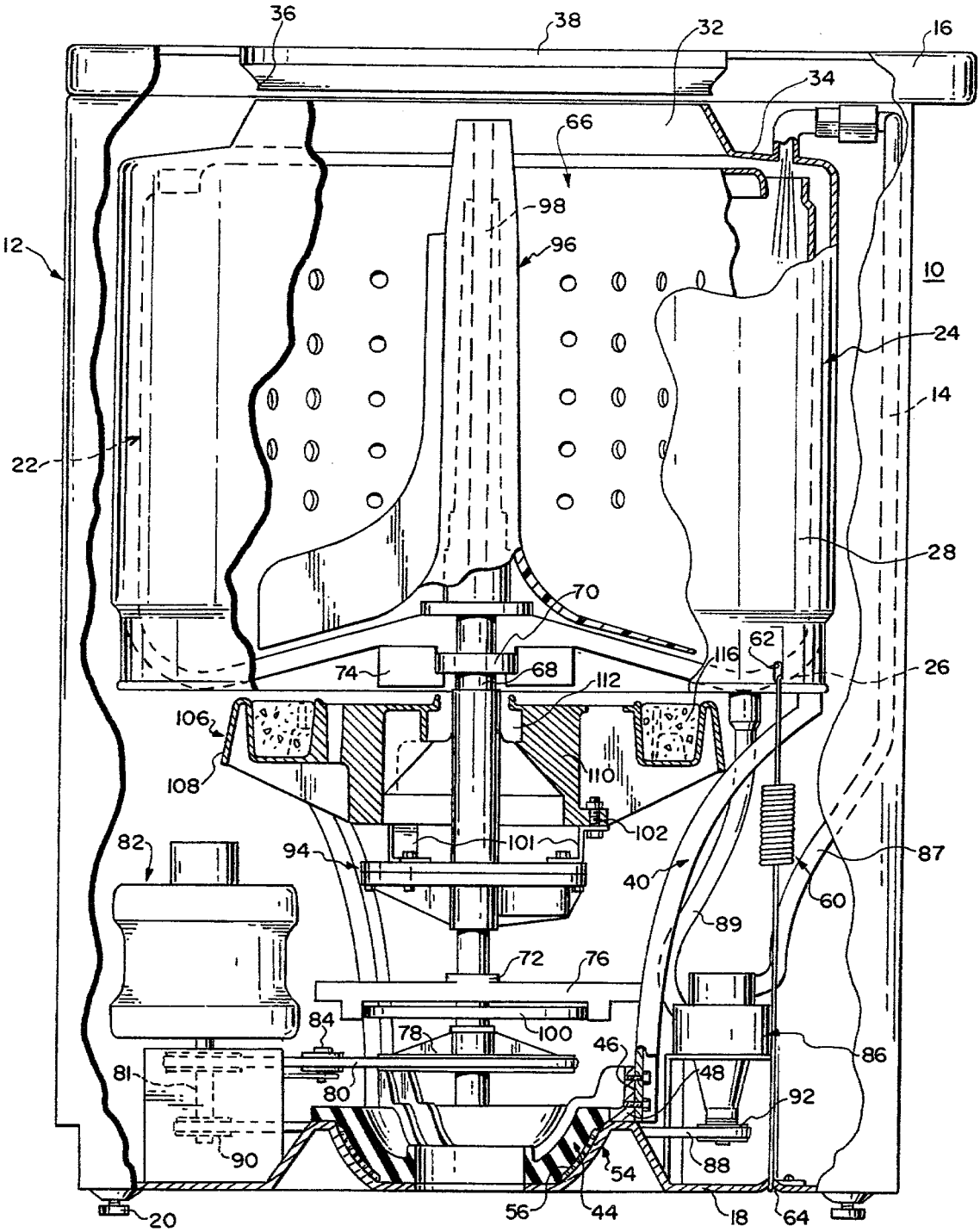
FIG. 1 is a side sectional view of a clothes washing machine including a suspension system for the tub assembly thereof, according to the invention.

Referring now to the drawings in greater detail wherein like numerals have been employed throughout the various views to designate similar components, a clothes washing machine, generally designated by the numeral 10, is illustrated in FIG. 1. The clothes washing machine 10 includes an outer housing or enclosure 12, having side walls 14, a top wall assembly 16 and a base 18. Suitable adjustable legs 20 are attached to the base 18 to support and level the machine.

Within housing 12 of the clothes washing machine 10 is mounted a clothes receiving tub or basket assembly 22, which includes an outer cylindrical stationary tub 24 having a base wall 26 and a side wall 28. At the top of the stationary tub is a raised lip forming an opening 32 in the top wall 34 of the tub to permit clothes to pass thereinto. An aligned opening 36 in the top wall assembly 16 of the machine housing provides access to opening 32. A hingedly mounted cover 38 forming a part of the top housing wall assembly 16, closes off the opening 32.

Figure 4:
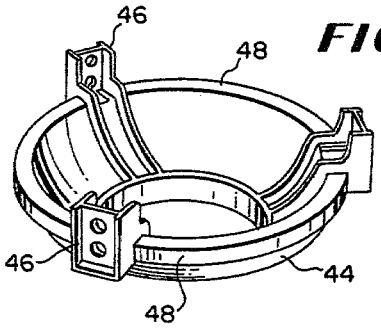
FIG. 4 is a perspective view of the truncated, hemispherical support cup employed in the suspension system of the clothes washing machine of FIGS. 1 and 2.
Figure 3:
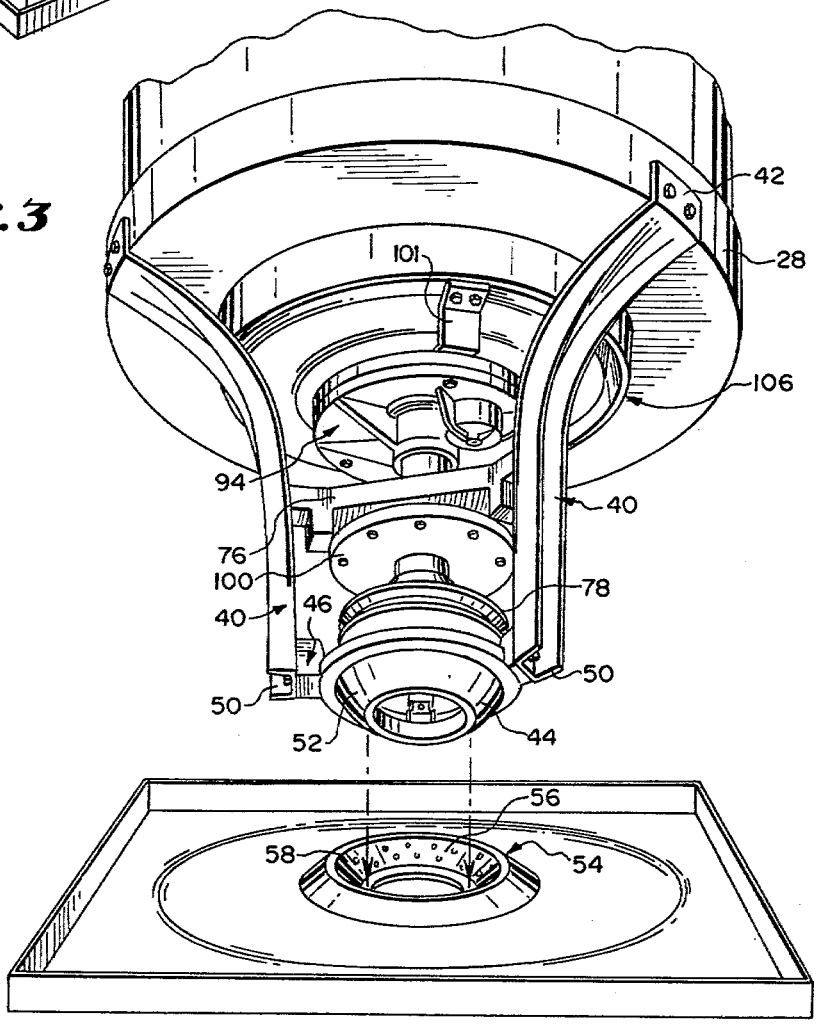
FIG. 3 is an exploded, fragmentary, perspective view of the suspension system according to the invention included in the clothes washing machine of FIGS. 1 and 2.

The tub assembly and drive mechanism, to be described hereinafter, is supported on a plurality of rigid, curved legs such as 40 attached to the outer stationary tub 24. In the preferred embodiment of the washing machine shown in the drawings, three legs, spaced 120 degrees apart, are provided. First ends 42 (FIG. 3) of the legs are attached, using bolts or other suitable fasteners, to the lower side wall 28 of the outer tub. The opposite ends of the legs converge and are attached to a convex, truncated, hemispherically shaped support cup, designated generally by the numeral 44 (see FIG. 4). Suitable brackets 46, also spaced 120 degrees about the larger diameter end 48 of the support cup, are provided for fastening ends 50 of the support legs 40 thereto, as shown in FIG. 3. The outer surface 52 of the support cup is relatively smooth and is received in a complementarily shaped, hemispherical cup 54 provided on the base 18 of the washing machine housing. In the preferred embodiment of the washing machine shown, the cup 54 is formed directly in the base 18 of the machine housing. A felt or the like pad 56, having perforations therein, is bonded on the mating surface 58 of cup 54 as an interface layer between the support and base cups 44, 54, respectively. The felt pad is perforated and a lubricant, such as grease, etc., is provided therein to promote a smooth pivotal movement between the cups. Alternatively, a preformed plastic or the like cup having low friction surfaces can be introduced between the support and base cups to serve in the same capacity as the lubricated felt pad.

A plurality of stabilizing coil springs, such as, 60, (FIG. 1), are attached between the lower end of the stationary tub and base 18. The ends of the springs are hooked into suitable apertures 62, 64 in the tub wall and base, respectively, to secure the springs under tension therebetween. In a preferred embodiment of the tub support system, five springs spaced about the base 18 are provided. Each spring is at about 20–25 pounds of tension.

Figure 2:
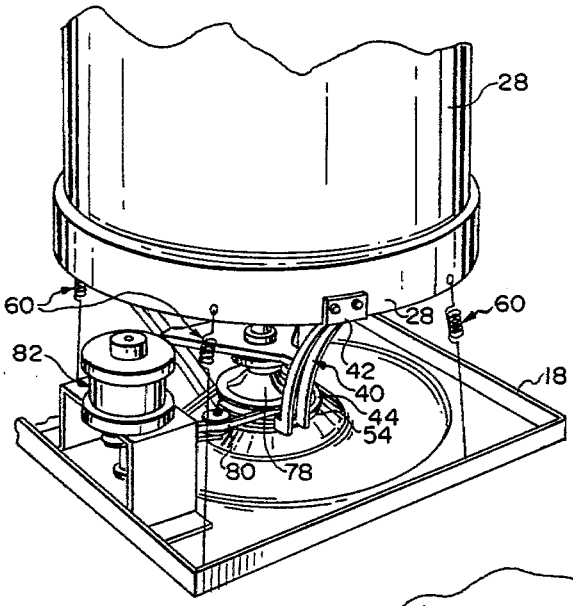
FIG. 2 is a fragmentary perspective view of the base, outer stationary tub, drive motor and suspension system of the clothes washing machine of FIG. 1.

The mating cups and stabilizing springs serve to maintain the tub assembly in an upright position as illustrated in the drawings, FIGS. 1 and 2.

Within the outer stationary tub is mounted, concentrically therewith, a slightly smaller diameter, cylindrical spin tub 66. The spin tub 66 is supported on a central shaft 68 which itself is supported in spaced bearing assemblies 70 and 72, see FIG. 1. Bearing assembly 70 is mounted in bearing block 74 which is welded or suitably secured to the inner surface of the base wall 26 of the outer stationary tub 24 and bearing assembly 72 is secured to or is formed as a part of a support brace 76 extending between the legs 40 supporting the tub assembly 22.

The central tub support shaft 68 extends downwardly toward the center of the hemispherical support cups 44, 54 and a pulley 78 is mounted on the shaft 68 at the lower end thereof. The pulley is joined by a drive belt 80 to the drive shaft 81 of a drive motor 82 mounted on the base 18 adjacent the support system. An idler wheel 84 is provided to insure proper tensioning of the belt under various types of operation of the washing machine; i.e., agitation, spin, etc. The drive motor is used also to drive a water pump 86 of the washing machine. The water pump circulates and drains water via hoses such as 87, 89 to and from the wash tub assembly. A drive belt 88 extends between a smaller pulley 90 mounted on the drive shaft 81 of the motor and a drive pulley 92 of the pump.

Supported on a central shaft 68 of the washing machine is a transmission 94 of a conventional type employed in automatic washing machines. The transmission provides agitation movement of an inner shaft 98 of the central shaft 68 when the drive motor is driven in a first direction. An agitator 96 removably mounted on the inner shaft 98 within tub 66, is oscillated in a stepped rotation during the wash cycle, thereby to remove soil from clothes placed in the tub. Reversal of the drive motor produces a spinning of the entire central shaft 68, transmission 94 and inner tub 66, at relatively high speeds in a direction opposite from that of the agitation cycle, for driving excess water from the clothes centrifugally after the rinse cycle. A brake assembly 100 included as a part of the washing machine drive mechanism, is located beneath the support brace 76. The brake assembly is employed to secure the central shaft 68 in a fixed position during the agitation cycle and to release the central shaft 68 for spinning during the spin cycle.

The operation of the washing machine in the agitate and spin cycles as described, is conventional and comprises no part of the present invention.

Figure 5:
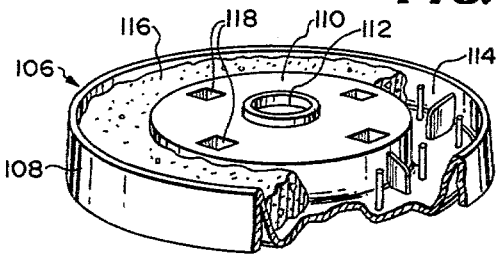
FIG. 5 is a fragmentary perspective view of the balance ring assembly employed in the suspension system of the clothes washing machine of FIGS. 1 and 2.

Mounted on the transmission housing by means of suitable brackets 101 and fasteners, such as bolts, 102 is a weighted "balance ring" assembly 106, according to the invention. A preferred embodiment of the balance ring assembly 106 is shown in greater detail in FIG. 5 of the drawings. The ring includes an outer molded plastic or the like shell 108 having a central hub portion 110 with a central aperture 112 extending therethrough and a circular recess 114 surrounding the central hub. Concrete 116 or other suitable material is introduced into the recess to give the balance ring a predetermined mass or weight. Apertures 118 in the central hub portion surrounding the central aperture 112, are employed for mounting the balance ring assembly on the transmission housing, see FIG. 1.

The balance ring assembly is located directly beneath the bottom wall of the outer tub 26 of the washing machine. The ring spins with the transmission, the other drive mechanism components and inner tub 66 during the spin cycle. The balance ring assembly, in combination with the mating support cups 44, 54, provide great stability to the inner tub 66 during the spin cycle, even in the case where clothes pile up at one location in the tub and cause an imbalance thereof. The mating cups support the washing machine tubs in a fixed location, but permit the entire system to pivot thereat. Sidewise movement is prevented by securing the outer tub to base 18 by means of coil springs 60, as described heretofore.

In a preferred embodiment of a washing machine including a suspension system according to the invention, the outer tub diameter is approximately 21.75 inches with the diameter of the inner tub being approximately 20 inches. In such case, a balance ring of approximately 15.75 inches has been selected for mounting beneath the outer tub base wall. Such diameter was chosen to permit the mounting of the ring at such location without interfering with the support legs 40 and other tub supporting structure of the washing machine. In such case, the weight of the balance ring is about 18 pounds. If the ring were increased in diameter, a lesser weight could be employed. Conversely, a decrease in diameter requires a greater weight in the balance ring. Typical values are: 20 inch diameter balance ring—8 to 10 pounds; 10 inch diameter balance ring—30 pounds.

A typical speed during the spin cycle of a preferred embodiment of the washing machine including the suspension system according to the invention, is approximately 600 revolutions per minute (rpm) with a speed of 50–100 rpm being the most critical as the greatest oscillation has been found to occur at such speed. In the preferred embodiment of the suspension system according to the invention, the diameter of the support cups is approximately 5 inches.

The system as shown permits up to a 6½ pound out-of-balance load to be included in the inner wash tub before the tub will spin sufficiently out of its proper path to cause excess vibration or engagement between the outer stationary tub and the enclosure. This is far superior to most prior art washing machine suspension systems.

The selection and placement of the balance ring as described; i.e., directly beneath the outer wall of the outer tub, in combination with the support cup members, provides the great stability realized. The placement of the balance ring is as close to the true center point of mass of the spinning tub and drive mechanism as is possible. In fact in the embodiment of the washing machine described, the true center point is located at the bottom of the inner rotatable tub 66, but mounting of a balance ring at such location is impractical and not advisable as it would interfere with the washing operation. As such, the best practical location for mounting a balance ring is directly beneath the outer tub 24 of the washing machine as described. In this fashion, the ring does not interfere with the operation of the machine yet serves in conjunction with the support cup arrangement, to satisfactorily stabilize the washing machine tub assembly.

It will be recognized by one skilled in the art that the key to the washing machine suspension system according to the invention is the provision of the mating support cup mounting which permits pivotal movement of the entire washing machine tub assembly and drive transmission, but without lateral movement, in combination with the balance ring of a predetermined weight and size, located as close as possible to the true center of mass of the rotating spin tub and drive mechanism. It should be recognized that the selection of the proper balance ring weight, diameter, diameter of the support cups, etc., will vary with the size, capacity and diameter of the washing machine tubs and the like.

I claim:

1. In a washing machine comprising a base and a wash tub assembly including an outer stationary tub and an inner clothes receiving tub mounted on a central shaft for rotation at relatively high spin speeds within said outer stationary tub, said shaft extending downwardly through the base wall of said outer tub and coupled via drive means to drive motor means mounted on said base, a suspension system for supporting said tub assembly in a relatively stable manner, said suspension system including in combination: a first rigid support cup having a predetermined shape joined to said washing machine base, a rigid support member coupled at a first end to said outer stationary tub, a second rigid support cup shaped complementarily to said first support cup and joined to said support member at a second end thereof, opposite said first end, said second support cup seatedly engaging said first support cup for pivotal movement with respect thereto, said first and second support cups supporting said tub assembly in a vertically oriented position, a plurality of resilient support members joined to and extending between said outer stationary tub and said base to maintain said tub assembly in said vertically oriented position, and a balance ring of solid construction having a predetermined weight and size, mounted on said central shaft as near as practical to the center of mass of said spinning tub and drive means, said balance ring being rotatable with said central shaft upon rotation of the latter in a first direction at relatively high speeds, said balance ring and said first and second support cups cooperating to stabilize said tub assembly when the clothes load in said rotatable tub is out of balance.

2. A suspension system as claimed in claim 1 wherein said first and second support cups each include inner and outer surfaces wherein said second support cup is received by said first support cup concentrically with respect thereto, and wherein one of the inner and outer surfaces of the first one of said support cups engage the other one of the inner and outer surfaces of the second one of said support cups.

3. A suspension system as claimed in claim 2 wherein each of said first and second support cups is a truncated hemisphere.

4. A suspension system as claimed in claim 2 wherein said first and second support cups open upwardly in the direction of said tub assembly and wherein said drive means includes transmission means joined to said central mounting shaft for rotation therewith upon rotation of said shaft in said first direction.

5. A suspension system as claimed in claim 4 wherein said balance ring is mounted on said transmission means adjacent said stationary tub, said transmission means being rotatable with said inner tub and balance ring during high speed rotation of said inner tub in said first direction.

6. A suspension system as claimed in claim 2 wherein said first support cup is formed integrally with and defined in said base.

7. A suspension system as claimed in claim 1 further including lubrication means provided between the mating surfaces of said first and second support cups for reducing the friction therebetween.

8. A suspension system as claimed in claim 7 wherein said lubrication means include a relatively soft pad with lubricant applied thereto.

9. A suspension system as claimed in claim 7 wherein said lubrication means includes a third cup formed of low friction material, having a shape and dimension similar to said first and second support cups and being received therebetween in mating engagement with the facing surfaces of said first and second support cups, respectively.

10. A suspension system as claimed in claim 1 wherein said resilient support members include spring members extending between said outer stationary tub and said base and being spaced predeterminedly thereabout, said spring members each being at a predetermined tension for supporting said tub assembly on said support cups.

11. A suspension system as claimed in claim 1 wherein said rigid support member includes a plurality of legs spaced about the periphery of said stationary tub and extending between said outer stationary tub and second support cup, opposite ends of the legs being attached to said tub and said second support cup, respectively.

* * * * *